US010118189B2

(12) United States Patent
Son et al.

(10) Patent No.: US 10,118,189 B2
(45) Date of Patent: Nov. 6, 2018

(54) FIXED NOZZLE AND PUMPING TYPE COSMETIC CONTAINER

(71) Applicant: YONWOO CO., LTD., Incheon (KR)

(72) Inventors: Su-Jin Son, Incheon (KR); Ki-Young Ham, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/559,122

(22) PCT Filed: Sep. 9, 2015

(86) PCT No.: PCT/KR2015/009487
§ 371 (c)(1),
(2) Date: Sep. 18, 2017

(87) PCT Pub. No.: WO2017/043673
PCT Pub. Date: Mar. 16, 2017

(65) Prior Publication Data

US 2018/0050360 A1 Feb. 22, 2018

(30) Foreign Application Priority Data

Sep. 7, 2015 (KR) ..... 10-2015-0126530

(51) Int. Cl.

| | |
|---|---|
| ***B65D 69/00*** | (2006.01) |
| ***B65D 71/00*** | (2006.01) |
| ***B05B 11/00*** | (2006.01) |
| ***A45D 34/00*** | (2006.01) |
| ***B65D 47/00*** | (2006.01) |

(52) U.S. Cl.
CPC ..... *B05B 11/3001* (2013.01); *A45D 34/00* (2013.01); *B05B 11/3053* (2013.01); *B65D 47/00* (2013.01); *A45D 2200/051* (2013.01)

(58) Field of Classification Search
CPC . B05B 11/3001; B05B 11/3053; A45D 34/00; A45D 2200/051; B65D 47/00
USPC ..... 206/581, 524.8, 229; 222/256, 321.1, 222/321.6, 321.7, 321.8, 321.9, 372, 373, 222/381, 383.1
See application file for complete search history.

(56) References Cited

U.S. PATENT DOCUMENTS 8,245,884 B2 * 8/2012 Byeon ..... A45D 40/0075 222/256
2015/0320175 A1 * 11/2015 Lee ..... A45D 34/00 222/372

FOREIGN PATENT DOCUMENTS

KR 20130003770 U 6/2013
KR 101311214 B1 10/2013
(Continued)

OTHER PUBLICATIONS

International Search Report issued in PCT/KR2015/009487, dated Jun. 1, 2016.

*Primary Examiner* — Rafael Ortiz
(74) *Attorney, Agent, or Firm* — Marshall, Gerstein & Borun LLP

(57) ABSTRACT

A fixed nozzle and pumping type cosmetic container, more specifically a fixed nozzle and pumping type cosmetic container wherein, since a pumping operation is performed in a state of a nozzle being fixated when a button is pressed, it is possible to apply contents on the exactly intended place, to prevent air from flowing by opening and closing a contents discharge hole by means of an opening and closing rod, and also to minimize leakage of contents through a leakage prevention part separately provided from a contents movement part.

5 Claims, 7 Drawing Sheets

(56) References Cited

FOREIGN PATENT DOCUMENTS

| | | | |
|---|---|---|---|
| KR | 20140110263 | A | 9/2014 |
| KR | 20150002182 | U | 6/2015 |
| WO | WO-2010047486 | A2 | 4/2010 |

* cited by examiner

[Fig. 1]
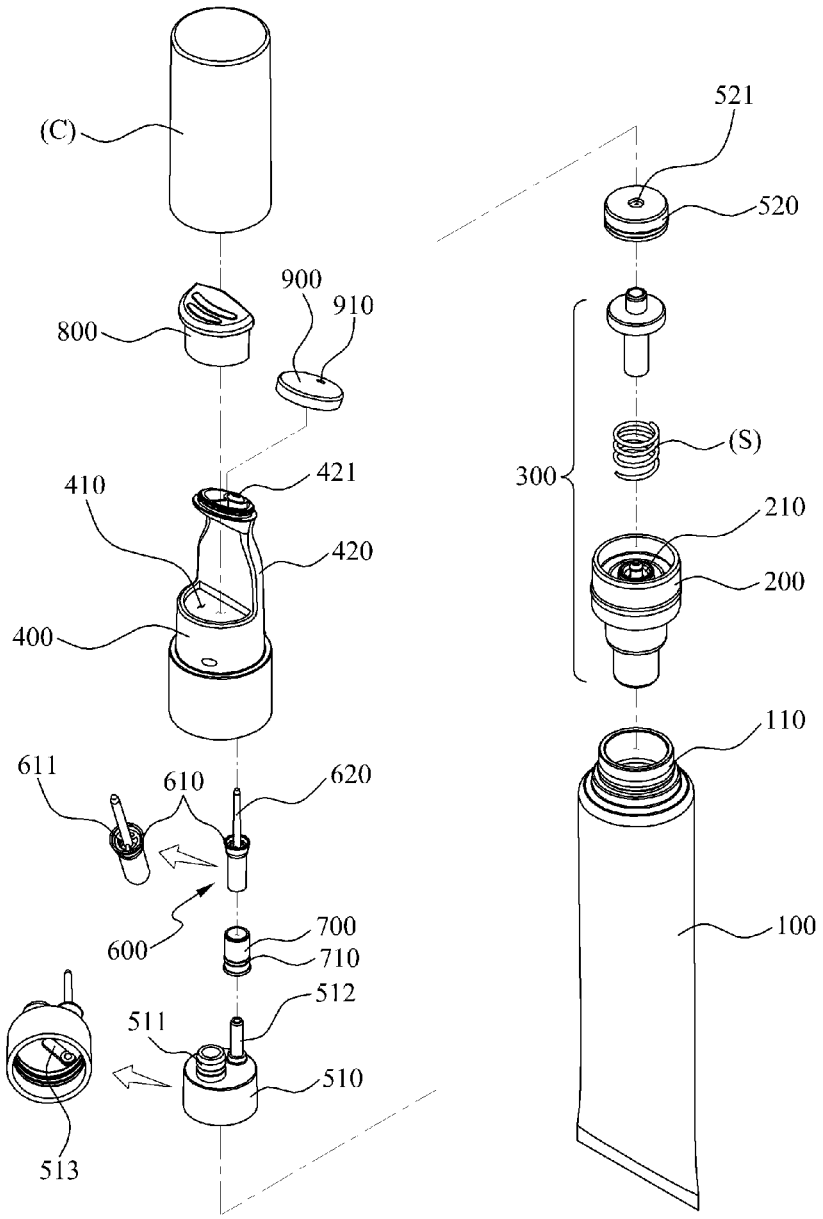

[Fig. 2]
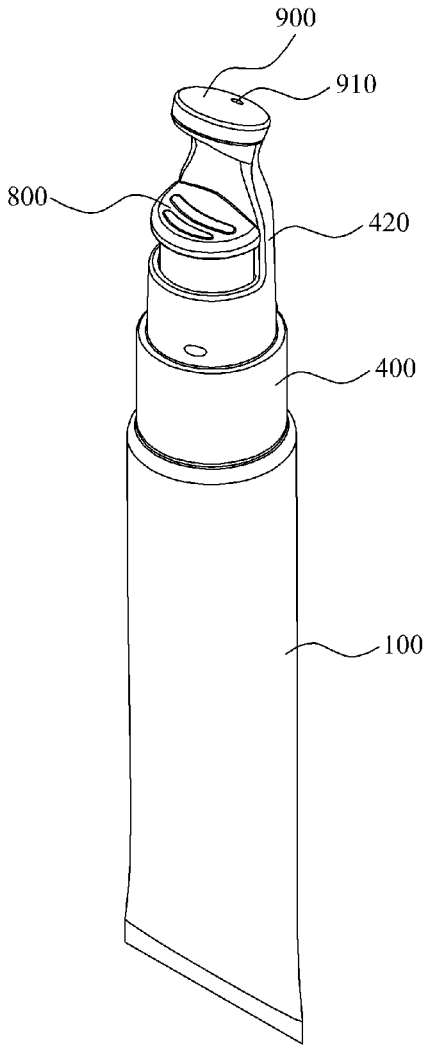

[Fig. 3]
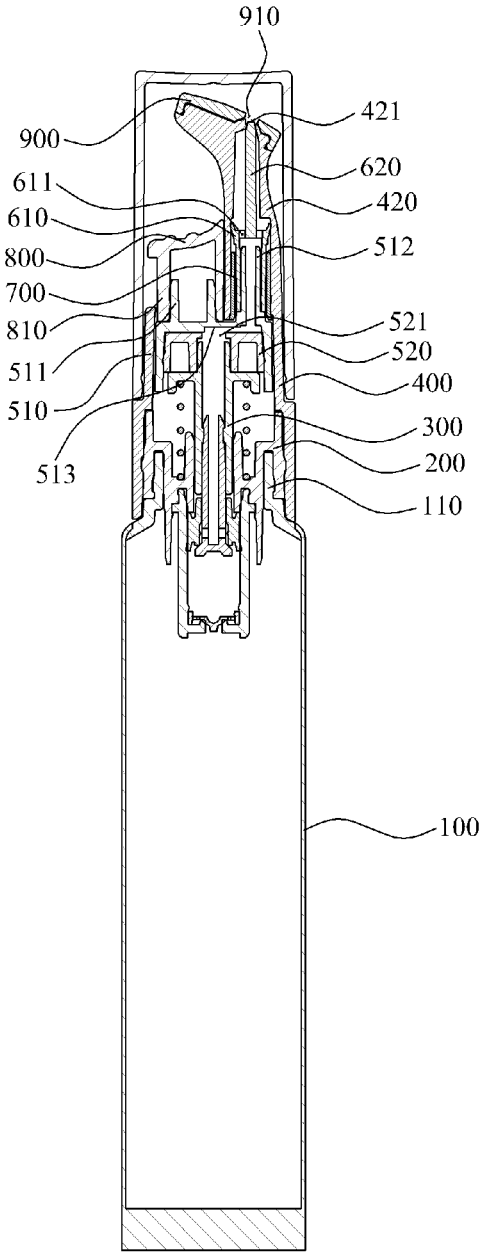

[Fig. 4]
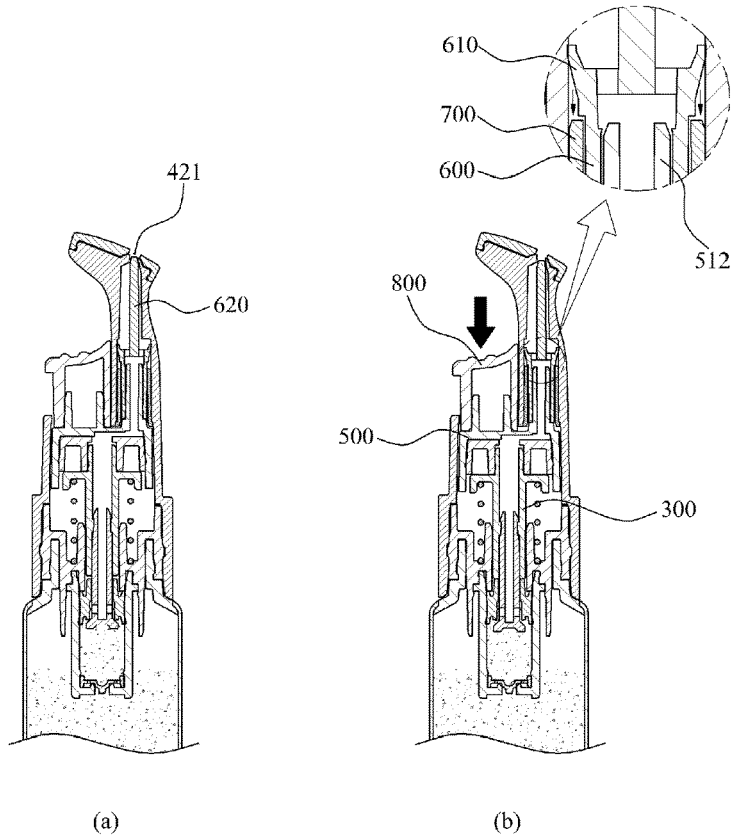
[Fig. 5]
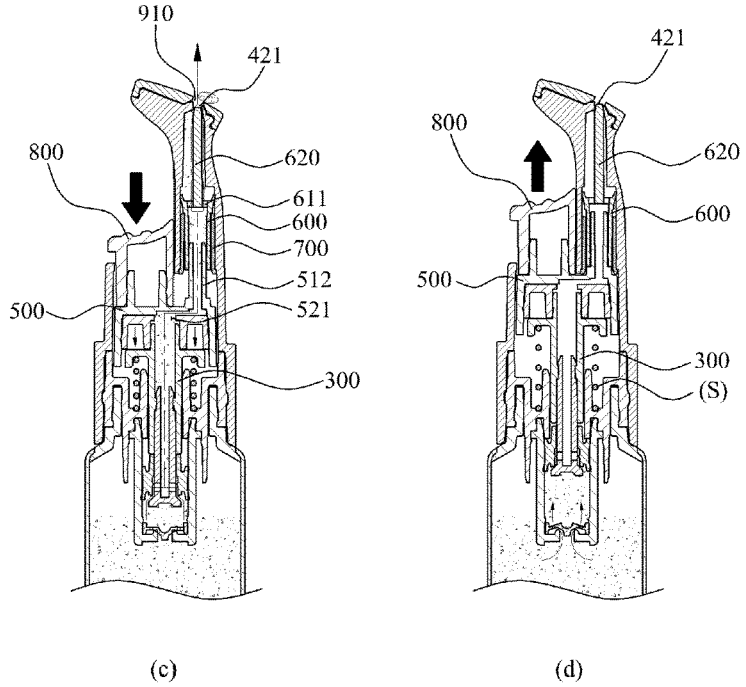

[Fig. 6]
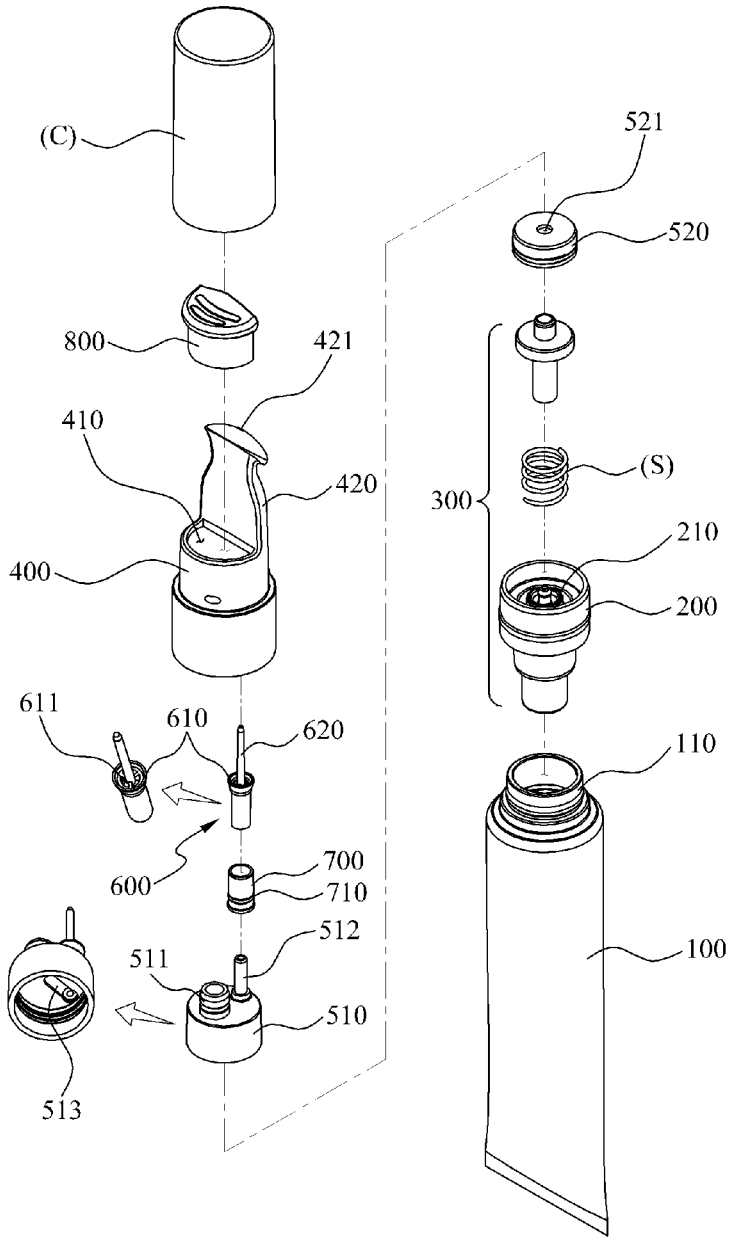

[Fig. 7]
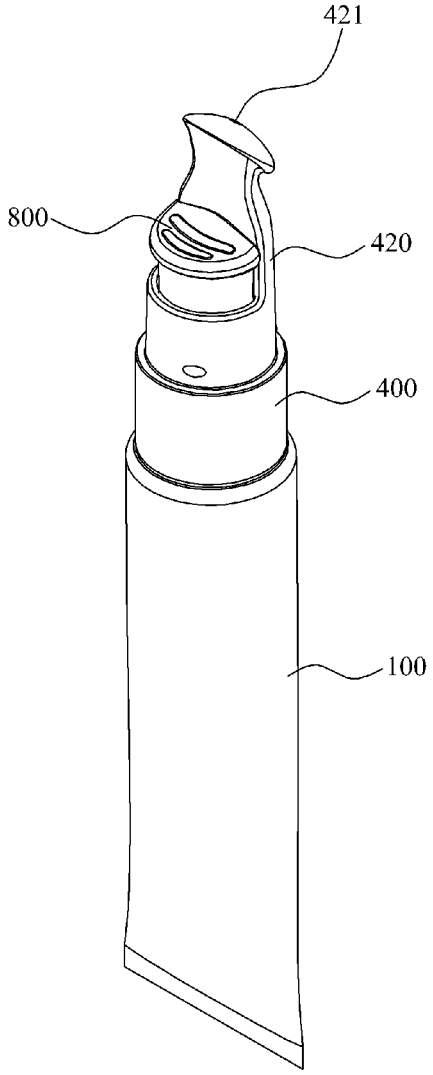

[Fig. 8]
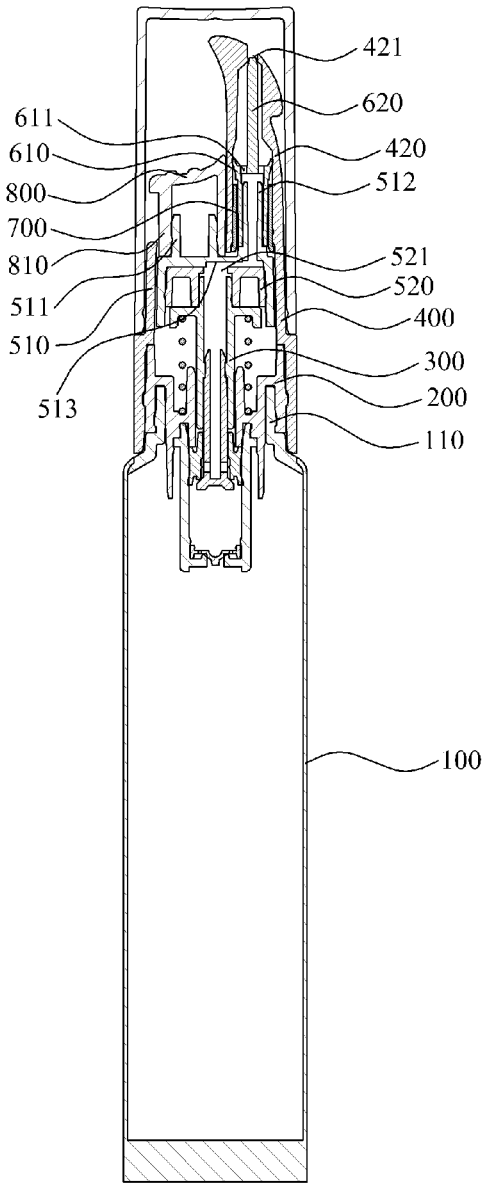

FIXED NOZZLE AND PUMPING TYPE COSMETIC CONTAINER

BACKGROUND

The present disclosure relates to a fixed nozzle and pumping type cosmetic container, more specifically a fixed nozzle and pumping type cosmetic container wherein, since a pumping operation is performed in a state of a nozzle being fixated when a button is pressed, it is possible to apply contents on the exactly intended place, to prevent air from flowing by opening and closing a contents discharge hole by means of an opening and closing rod, and also to minimize leakage of contents through a leakage prevention part separately provided from a contents movement part.

Generally, a pumping type of cosmetics container, configured to discharge contents to the outside through a pumping operation of a pumping member coupled to a container body, includes: a container body where contents are received, a pumping member which is coupled to an upper portion of the container body and draws up the contents through a pumping operation by making the interior of the container body a state of vacuum; and a button part which is disposed at an upper portion of the pumping member and ascends/descends according to user's pressurizing, ang thereby transferring the pressure to the pumping member.

However, such pumping type cosmetic containers as the above configuration has a discharge hole where contents are discharged is formed at a button part and discharges contents according to pumping operation of the pumping member. Since the discharge hole provided at the button part moves in company when the button part moves up and down according to the button part being pressed, there arise a problem that it is difficult to apply contents on an exactly intended place.

To solve the above problem, "a fixed nozzle and pumping type cosmetic container" which is configured to discharge contents in a state that the discharge hole is fixated without the discharge hole moving even when the button part moves up and down is disclosed in the Korean registered patent no. 10-1311214 (hereafter called as 'the registered patent')

The registered patent is characterized to include: a container body receiving contents; a support body coupled to an upper portion of the container body and provided with a hollow; a pumping member coupled to the support body and performing a pumping operation such that contents received in the container body can be discharged to the outside; a finishing cap coupled, encasing the support body and the pumping member at an upper portion of the container body, forming a button insertion hole, wherein a nozzle with a contents discharge hole extends in an upper direction; a contents movement part coupled to an upper portion of the pumping member at an inner side of the finishing cap and moving content that moves through the pumping member to the contents discharge hole; and a button inserted to an button insertion hole of the finishing cap and ascending and descending separately from the finishing cap, and coupled to the contents movement part and pressurizing the contents movement part.

The registered patent is provided with a movement tube which extends in an upward direction from an upper end of the coupling body comprising a contents movement part, and ascends/descends along with the ascent/descent of the contents movement part, further comprising a passage where contents move to a nozzle. Since an upper portion of the movement tube is configured to have a shape of a piston which is closely contacted to an inner circumferential surface, a pressure is generated in a direction of the contents discharge hole while the movement tube is ascending by clearing the button pressurization, which may result in a problem that a large amount of contents is leaked while contents disposed at a dead end of the nozzle is being discharged.

SUMMARY OF THE DISCLOSURE

The present disclosure is devised to solve the problem described in the above. The objectives of the presently described embodiments is to provide a fixed nozzle and pumping type cosmetic container, wherein since a pumping operation is performed in a state of a nozzle being fixated when a button is pressed, it is possible to apply contents on an exactly intended place, to prevent air from flowing by opening and closing a contents discharge hole by means of an opening and closing rod, and also to minimize the leakage of contents through a leakage prevention part separately provided from a contents movement part.

solve the problems in the above, a fixed nozzle and pumping type cosmetic container according to the present disclosure includes: a container body storing contents; a support body coupled to an upper portion of the container body, provided with a hollow, and supporting a pumping member; a pumping member coupled to the support body and performing a pumping operation such that contents stored in the container body can be discharged to the outside; a finishing cap encasing the support body and the pumping member at an upper portion of the container body, provided with a button insertion hole at an upper portion thereof, and including a nozzle which forms a contents discharge hole and extends to an upper direction; a contents movement part disposed at an upper portion of the pumping member at the inside of the finishing cap, and moving contents which move to an upper portion thereof by a pumping operation of the pumping member to the contents discharge hole; a leakage prevention part, coupled to an upper portion of the contents movement part and moving in company with the contents movement part, further comprising a piston part wherein an upper portion thereof is closely provided at an inner circumferential surface of the nozzle and prevents the contents from moving along the inner circumferential surface of the nozzle to a lower portion thereof and a plurality of content movement holes are formed therein, and further comprising an opening/closing rod protrusively formed from a center of the piston part toward an upper portion thereof and opening and closing the contents discharge hole; a fixation tube encasing an inner circumferential surface of the nozzle and fixated at an inner side of the finishing cap and further limits the descent of the leakage prevention part; and a button part inserted to the button insertion hole of the finishing cap and ascending/descending separately from the finishing cap, and coupled to the contents movement part and transferring the pressure generated by user's pressing the button to the contents movement part, wherein it is characterized wherein, in a process of descending with the leakage prevention part as the contents movement part descends in company by pressing of the button part, the piston part is limited to descend by the fixation part and thereby the contents movement part dependently descends and then, the leakage prevention part is restored while the contents movement part is ascending by releasing of the button part Furthermore, it is characterized in that the contents movement part includes a body which encases an upper portion of the pumping member; a button fixation protrusion which extends from an upper surface of the body to an upward direction and fixes the button part; a movement tube that forms a passage where contents flowing out by a pumping operation of the pumping member can move; and a guide part which guides contents to move such that the contents flowing out by an pumping operation of the pumping member can move to the movement part.

Furthermore, it is characterized in that the contents movement part further includes a communication part which is coupled to an upper portion of the pumping member at an inner side of the contents movement part, and is provided with a contents outflow hole such that contents flowing out by a pumping operation of the pumping member can move to the movement tube.

Furthermore, it is characterized in that an applicator is integrally installed at an end of the nozzle such that it is possible to apply contents being discharged through the contents discharge hole onto the skin.

Furthermore, it is characterized in that an applicator made of metal is coupled at an end of the nozzle such that it is possible to apply contents being discharged through the contents discharge hole onto a skin.

According to the present disclosure, as described in the above, when pressing a button, a pumping operation is performed in a state of a nozzle being fixed; therefore, it is possible to apply contents on the exactly intended place, to prevent air from flowing by opening and closing a contents discharge hole by means of an opening and closing rod, and also to minimize leakage of contents through a leakage prevention part separately provided from a contents movement part.

BRIEF DESCRIPTION OF THE DRAWINGS

FIG. 1 is an exploded perspective view illustrating a configuration of a fixed nozzle and pumping type cosmetic container according to an exemplary embodiment.

FIG. 2 is an assembled perspective view illustrating a configuration of to a fixed nozzle and pumping type cosmetic container according to an exemplary embodiment.

FIG. 3 is a cross-sectional view illustrating a configuration of a fixed nozzle and pumping type cosmetic container according to an exemplary embodiment.

FIGS. 4 and 5 are operational state views illustrating a configuration of a fixed nozzle and pumping type cosmetic container according to an exemplary embodiment.

FIG. 6 is an exploded perspective view illustrating a configuration of fixed nozzle and pumping type cosmetic container according to another exemplary embodiment.

FIG. 7 is an assembled perspective view illustrating a configuration of to a fixed nozzle and pumping type cosmetic container according to another exemplary embodiment.

FIG. 8 is a cross-sectional view illustrating a configuration of a fixed nozzle and pumping type cosmetic container according to another exemplary embodiment.

DETAILED DESCRIPTION

Hereinafter, exemplary embodiments will be described in detail with reference to the accompanying drawings. The same reference numerals provided in the drawings indicate the same members.

FIG. 1 is an exploded perspective view illustrating a configuration of a fixed nozzle and pumping type cosmetic container according to an exemplary embodiment. FIG. 2 is an assembled perspective view illustrating a configuration of to a fixed nozzle and pumping type cosmetic container according to an exemplary embodiment. FIG. 3 is a cross-sectional view illustrating a configuration of a fixed nozzle and pumping type cosmetic container according to an exemplary embodiment.

Referring to FIGS. 1 to 3, a fixed nozzle and pumping type cosmetic container according to an exemplary embodiment includes a container body 100, a support body 200, a pumping member 300, a finishing cap 400, a contents movement part 500, a leakage prevention part 600, a fixation tube 700, and a button part 800.

The container body 100 which stories contents is provided with a coupling part 110 at an upper portion thereof for coupling with a support body 200. In drawings of the present embodiments, the container body 100 is illustrated as a tube type, but can be composed of various containers that are able to receive contents.

The support body 200, coupled to a coupling part 110 at an upper portion of the container body 100 and supporting a pumping member 300, is provided with a hollow 210 for coupling with a pumping member 300.

The pumping member 300, coupled to the support body 200 and performing a pumping operation for discharging contents stored in the container body 100 to the outside, belongs to a prior art; therefore, detailed description will be omitted.

The finishing cap 400, coupled as encasing the support body 200 and the pumping member 300 at an upper portion of the container body 100, comprises a button insertion hole 410 such that a button part, to be described later, can be inserted at an upper portion thereof, and is formed with a nozzle 420 which has a contents discharge hole 421 at a slanted position from the button insertion hole 410.

In the present disclosure, embodiments are characterized in that the finishing cap 400 is separately formed from a button part 800 in a state of being fixed to the support body 200 and does not move according to the ascent/descent of the button part 800. Due to this, it is possible to discharge contents in a state that a contents discharge hole 421 formed at the nozzle 420 and therefore, possible to apply contents onto an exactly intended place.

Meanwhile, it is characterized in that an applicator made of metal is coupled to an upper end of the nozzle 420 so as to apply contents discharged through the contents discharge hole 421 onto a skin. Since it is possible to transfer heat or cold onto the skin when applying contents through the applicator made of metal, a metabolism and an elasticity of the skin can be enhanced. The applicator 900 is formed with a discharge hole 910 communicated with the contents discharge hole 421.

As illustrated in FIGS. 6 to 8, it is possible that the applicator 900 is integrally formed at a dead end of the nozzle 420 in a process of formation of the nozzle 420.

The contents movement part 500, disposed at an upper portion of the pumping member 300 at an inner side of the finishing cap 400 and moving contents which move to an upper portion thereof through a pumping operation of the pumping member 300 to the contents discharge hole 421, comprises a body 510 encasing an upper portion of the pumping member 300; a button fixation protrusion 511 extending from an upper surface of the body 510 to an upward direction and fixes a button part; a movement tube 512 provided with a passage where contents flowing out by a pumping operation of the pumping member 300 move; and a guide part 513 which guides the movement of contents so as to move the contents flowing in by a pumping operation of the pumping member 300 to the movement tube 512.

At an inner side of the contents movement part 500 is provided a communication part 520 which is coupled to an upper portion of the pumping member 300 and communicates the pumping member 300 and the movement tube 512, and a contents discharge hole 521 is formed at a center of the communication part 520 such that the contents flowing out from the pumping member 300 by a pumping operation of the pumping member 300 can move to the movement tube 512.

The leakage prevention part 600 is coupled to the movement 512 configuring an upper portion of the contents movement part 500 and moves along together the ascent/descent of the contents movement part 500. The presently disclosed embodiments are characterized in that at the leakage prevention part 600 are provided a piston part 610 which has a plurality of contents movement holes 611 formed at an upper end thereof and prevents the contents which move in a downward direction in a state of discharge being completed from flowing down along an inner wall of the nozzle 420.

The piston part 610 is closely contacted to an inner circumferential surface of the nozzle 420, and thereby prevents the contents having moved to an upper portion through a contents movement hole 611 from flowing down an inner wall of the nozzle 420.

Meanwhile, at the leakage prevention part 600 is provided an opening and closing rod 620 which is protrusively formed from a center of the piston part 610 to an upper portion thereof and opens and closes the contents discharge hole 421. The opening and closing rod 620, at a normal state, closes the content discharge hole 421, and prevents air from flowing in and contents from flowing out. When a contents movement 500 move to a downward direction by pressurization of the button part 800, the opening and closing rod 620 opens the contents discharge hole 421 and makes it possible to discharge the contents to the outside through the contents discharge hole 421.

The fixation tube 700, fixed encasing an inner circumferential surface of the nozzle 420 at an inner side of the finishing cap 400, forms a fixation protrusion 710 at an outer circumferential surface thereof such that it is possible to be fixed to an inner circumferential surface of the nozzle 420.

The presently disclosed embodiments are characterized in that the fixation tube 700 is configured to limit the descent of the leakage prevention part 600. When the leakage prevention part 600 descends according to pressurization of the button part 800, the fixation tube 700 meets a piston part 610 separated with a narrow margin from an upper end of the fixation tube 700 and supports the piston part 610, such that it is possible to descend in as narrow a margin as the leakage prevention part 600 is separated from an upper end of the fixation tube 700. Due to this, it is possible to open and close the content discharge hole 421 by the opening and closing rod 620, and to minimize the pressure generated in a direction of the contents discharge hole 421 in a process the piston part 610 is ascended by releasing the pressurization of the button part by minimizing the travel distance the piston part 610.

The presently disclosed embodiments are structurally configured in that when the button part 800 is pressurized, contents are discharged by a pumping action of the pumping member 300, and when the button part 800 is released from being pressurized, contents disposed at a top end of the nozzle 420 are discharged to the outside by the piston part 610. The presently disclosed embodiments are characterized in that by minimizing the travel distance of the piston part 610 by means of the structure of the leakage prevention part 600 and the fixation part 700 which are separately formed from the contents movement part 500 when the button part 800 is released from being pressurized, it is possible to minimize the leakage of contents since contents disposed at a top end of the nozzle 420 are discharged to the outside by the piston part 610.

The button part 800, inserted into a button insertion hole 410 of the finishing cap 400 and descends by user's pressing and then ascends by an elastic force of the spring (S) of the pumping member 300 when the pressing is released, is provided with a coupling protrusion 810 such that the button part 800 can be combined-fitted to the button fixation protrusion 511 and pressurizes the contents movement part 500.

The presently disclosed embodiments are characterized in that the button part 800 is separately formed from the finishing cap 400 and independently ascends and descends. Due to this, while the button part 800 only is ascending and descending in a state that the contents discharge hole 421 provided at the finishing cap 400 is fixed during a pumping action, contents are discharged; therefore, it is possible to apply contents exactly on the intended place.

Hereinafter, with reference to FIGS. 4 and 5, an operation process of to a fixed nozzle and pumping type cosmetic container according to an exemplary embodiment will be described. FIGS. 4 and 5 are operational state views illustrating a configuration of a fixed nozzle and pumping type cosmetic container according to an exemplary embodiment.

Referring to FIGS. 4 and 5, in the fixed nozzle and pumping type cosmetic container according to an exemplary embodiment, at a normal state when not in use, an opening and closing rod 620 closes a contents discharge hole 421 for preventing the inflow of air and the leakage of contents, and then when a user presses the button part 800, a contents movement part 500 coupled to a lower portion of the button part 800 moves in a downward direction. Due to this, an opening and closing rod 524 moves in company in a downward direction and opens the contents discharge hole 421, thereby discharging contents through the contents discharge hole 421.

As described in the above, when the contents movement part 500 descends, a leakage prevention part 600 coupled to a movement tube 512 descends in company. At this time, since the descent of a piston part 610 is limited by a fixation tube 700, the descent of the leakage prevention part 600 is stopped, and the contents movement part 500 independently descends and a pumping action of the pumping member 300 is performed, such that contents go through a contents outflow hole 521, a contents movement tube 512, and a contents discharge hole 421, and finally are discharged through a contents discharge outlet 910.

Next, when the button part 800 is released from being pressurized, the contents movement part 500 ascends by the spring (S) of the pumping member 300 and restore the button part 800 coupled to an upper portion of the contents movement part 500 to the original place. As in the above, when the contents movement part 500 ascends as in the above, the leakage prevention part 600 ascends in company and thereby the contents discharge hole 421 is closed by the opening and closing rod 620.

As described above, optimal embodiments have been disclosed in the drawings and the specification. Although specific terms have been used herein, these are only intended to describe the contemplated embodiments and are not intended to limit the meanings of the terms or to restrict the scope of the claims as disclosed in the specification. Therefore, those skilled in the art will appreciate that various modifications and other equivalent embodiments are possible from the above embodiments. Therefore, the scope of the claims should be defined by the technical spirit of the specification.

What is claimed is:

1. A fixed nozzle and pumping type cosmetic container, comprising:

a container body storing contents;

a support body coupled to an upper portion of the container body, provided with a hollow, and supporting a pumping member, the pumping member coupled to the support body and performing a pumping operation such that contents stored in the container body can be discharged to the outside;

a finishing cap encasing the support body and the pumping member at an upper portion of the container body, provided with a button insertion hole at an upper portion thereof, and further comprising a nozzle forming a contents discharge hole and extends to an upper direction;

a contents movement part disposed at an upper portion of the pumping member at the inside of the finishing cap, and moving contents moving to an upper portion thereof by a pumping operation of the pumping member to the contents discharge hole;

a leakage prevention part, coupled to an upper portion of the contents movement part and moving in company with the contents movement part, further comprising a piston part wherein an upper portion thereof is closely provided at an inner circumferential surface of the nozzle and prevents the contents from moving along the inner circumferential surface of the nozzle to a lower portion thereof and a plurality of content movement holes are formed therein, and further comprising an opening/closing rod protrusively formed from a center of the piston part toward an upper portion thereof and opening and closing the contents discharge hole;

a fixation tube encased within the inner circumferential surface of the nozzle and fixated at an inner side of the finishing cap and thereby limiting the descent of the leakage prevention part; and a button part inserted to the button insertion hole of the finishing cap and ascending/descending separately from the finishing cap, and coupled to the contents movement part and transferring the pressure generated by pressing of the button part by a user to the contents movement part, wherein, in a process of descending with the leakage prevention part as the contents movement part descends in company by pressing of the button part, the piston part is limited to descend by the fixation tube and thereby the contents movement part dependently descends and then, the leakage prevention part is restored while the contents movement part is ascending by releasing of the button part.

2. The fixed nozzle and pumping type cosmetic container of claim 1, wherein the contents movement part comprises:

a body which encases an upper portion of the pumping member;

a button fixation protrusion which extends from an upper surface of the body to an upward direction and fixes the button part;

a movement tube that forms a passage where contents flowing out by a pumping operation of the pumping member can move; and a guide part which guides contents to move such that the contents flowing out by a pumping operation of the pumping member can move to the movement tube.

3. The fixed nozzle and pumping type cosmetic container of claim 2, wherein the contents movement part further includes a communication part which is coupled to the upper portion of the pumping member at an inner side of the contents movement part, and is provided with a contents outflow hole such that contents flowing out by a pumping operation of the pumping member can move to the movement tube.

4. The fixed nozzle and pumping type cosmetic container of claim 1, wherein an applicator is integrally installed at an end of the nozzle such that it is possible to apply contents being discharged through the contents discharge hole onto the skin.

5. The fixed nozzle and pumping type cosmetic container of claim 1, wherein an applicator made of metal is coupled at an end of the nozzle such that it is possible to apply contents being discharged through the contents discharge hole onto a skin.

* * * * *